US006306552B1

(12) United States Patent
Yasunaga et al.

(10) Patent No.: US 6,306,552 B1
(45) Date of Patent: Oct. 23, 2001

(54) CARRIER HAVING SPECIFIED BET SPECIFIC SURFACE AREA AND DYNAMIC CURRENT VALUE AND TWO-COMPONENT DEVELOPER THEREOF

(75) Inventors: Hideaki Yasunaga, Ibaraki; Makoto Kobayashi, Kobe; Koichi Takenaka, Katano; Osamu Maeda, Sanda; Tomoharu Nishikawa, Hirakata, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/625,042

(22) Filed: Jul. 24, 2000

(30) Foreign Application Priority Data

Jul. 28, 1999 (JP) ..... 11-213550

(51) Int. Cl.[7] ..... G03G 9/107
(52) U.S. Cl. ..... 430/111.4; 430/137.2
(58) Field of Search ..... 430/106.6, 108, 430/111, 122

(56) References Cited

U.S. PATENT DOCUMENTS

| | | | | |
|---|---|---|---|---|
| 4,126,454 | | 11/1978 | Jones | 96/15 D |
| 5,688,623 | | 11/1997 | Nakamura et al. | 430/106.6 |
| 5,834,152 | * | 11/1998 | Yasunaga et al. | 430/108 |
| 6,007,956 | * | 12/1999 | Yasunaga et al. | 430/108 |
| 6,054,243 | * | 4/2000 | Yamane et al. | 430/106.6 |
| 6,146,801 | * | 11/2000 | Ichikawa et al. | 430/106.6 |

FOREIGN PATENT DOCUMENTS

| | | |
|---|---|---|
| 8-160673 | 6/1996 | (JP) . |
| 8-190225 | 7/1996 | (JP) . |

* cited by examiner

*Primary Examiner*—John Goodrow
(74) *Attorney, Agent, or Firm*—Burns, Doane, Swecker & Mathis, LLP

(57) ABSTRACT

A carrier having a BET specific surface area of 0.50 to 2.00 $m^2$ and a dynamic current value of 15 to 170 nA and a two-component developer comprising such a carrier and toner.

20 Claims, 1 Drawing Sheet

CARRIER HAVING SPECIFIED BET SPECIFIC SURFACE AREA AND DYNAMIC CURRENT VALUE AND TWO-COMPONENT DEVELOPER THEREOF

This application is based on application(s) No. 213550/1999 filed in Japan, the contents of which are hereby incorporated by reference.

BACKGROUND OF THE INVENTION

1. Field of the Invention

The present invention relates to a carrier and a two-component developer containing such a carrier.

2. Description of the Related Art

Conventionally, various carriers, which include a coat-type carrier made by coating magnetic particles with a resin, a binder-type carrier made by dispersing magnetic particles in a binder resin and a carrier using magnetic particles as they are, have been known. However, the application of any of these types of carriers causes the toner component to adhere to the carrier surface (to be spent), when used for a long time, resulting in a reduction in the chargeable points and the subsequent failure in maintaining the initial charge-applying capability of the carrier. The reduction in the initial charge-applying capability causes a failure in obtaining a predetermined quantity of charge, resulting in fog on a copied image.

Moreover, in the case when the coat-type carrier and the binder-type carrier having a resin on the surface thereof are used to copy an image having continuous areas with a comparatively high density and a comparatively low density for a long time, a problem (referred to as a lead-off phenomenon) arises, in which an image-less portion occurs in the border between the high-density area and the low-density area on the copied image.

Furthermore, the application of the carrier of the type using magnetic particles as they are causes a problem in which the carrier is developed together with the toner and spent at the time of continuous copying processes.

Here, in order to improve the binding properties of the coating material, with respect to the coat-type carrier, a carrier has been proposed in which a porous spherical carrier base material, made by sintering magnetic particles, is coated with a resin (Japanese Patent Laid-Open No. Hei. 8-160673). Such sintered spherical magnetic particles used as the carrier base material are obtained by highly filling the resin with magnetic particles, forming this into a spherical shape, and sintering the resulting particle. However, in the carrier of this type also, the problems of fog (due to separation of the coating material) and lead-off have still arisen during endurance copying processes.

SUMMARY OF THE INVENTION

The objective of the invention is to provide a carrier and a two-component developer which can prevent the occurrence of fog and lead-off for a long time, and reduce the carrier consumption.

The present invention relates to a carrier that has a BET specific surface area of 0.50 to 2.00 $m^2/g$ and a dynamic current value of 15 to 170 nA, and a two-component developer comprising a toner and such a carrier.

DETAILED DESCRIPTION OF PREFERRED EMBODIMENTS

The carrier has a BET specific surface area of 0.50 to 2.00 $m^2/g$, preferably 0.51 to 1.85 $m^2/g$, and a dynamic current value of 15 to 170 nA, preferably 20 to 150 nA. The BET specific surface area of less than 0.50 $m^2/g$ causes a reduction in the carrier chargeable points, and the subsequent degradation in the initial charge-applying capability due to spent toner components at the time of continuous copying processes, resulting in fog in the copied image. In contract, the BET specific surface area exceeding 2.00 $m^2/g$ causes a fragile state in which many voids exist in its structure, resulting in an insufficient mechanical strength and the subsequent increase in the carrier consumption. The dynamic current value less than 15 nA makes the surface resistance of the carrier comparatively high, with the result that, upon copying an image having continuous areas with a comparatively high density and a comparatively low density for a long time, a (lead-off) phenomenon takes place, in which an image-less portion occurs in the border between the high-density area and the low-density area on the copied image. In contrast, the dynamic current value exceeding 170 nA makes the surface resistance of the carrier comparatively low, with the result that, during continuous copying processes, the carrier is spent together with the toner, resulting in an increase in the carrier consumption.

In the present specification, with respect to the BET specific surface area, values measured by an NS-12 system (made by QUANTACHROME CORP.) were used; however, the measurements are not necessarily made by this device, and any device may be used as long as the measurements are made based upon the principle of this device.

Figure 1:
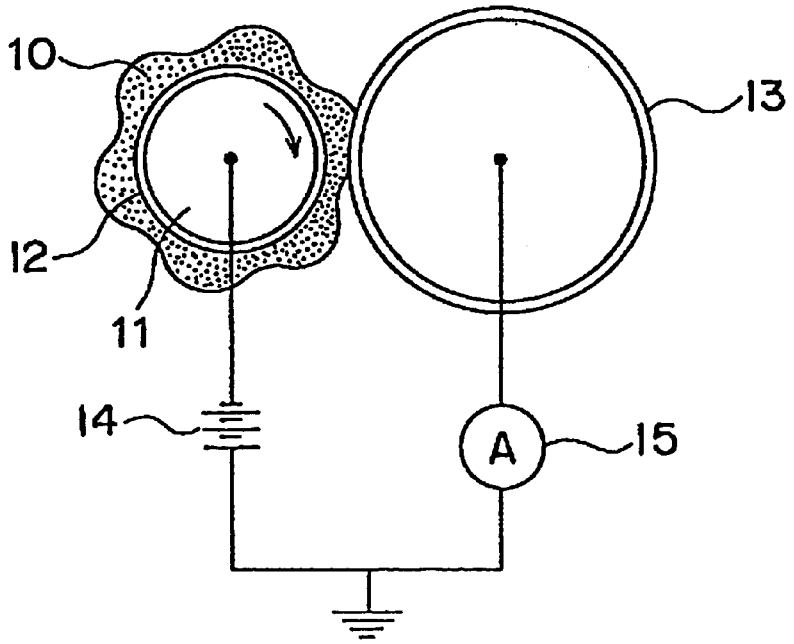
FIG. 1 is an explanatory view that schematically shows a device for measuring the dynamic current value of a carrier.

The carrier dynamic current value (CDC value), obtained by using a construction schematically shown in FIG. 1 through the following method, is used.

Carrier (10) is set on an aluminum sleeve (12), and a voltage is applied thereto from a dc power supply (14), while the sleeve (12) is being rotated. The current flowing through a current meter (15) via the carrier (10) and an aluminum cylinder (13) from the sleeve (12) is measured. The measuring conditions are as follows:

| | |
|---|---|
| Number of revolutions of the sleeve: | 50 rpm |
| Applied voltage: | 500 V |
| Amount of the sample: | 5 g |
| Sleeve (12) | |

Length in the length direction: 55 mm, Diameter: 31 mm, Magnetic force of the magnet: 1000 gauss, Number of magnetic poles: 8.

Aluminum cylinder (13) Length in the length direction: 55 mm, Diameter: 30 mm The carrier may be made from any material as long as it has the above-mentioned BET specific surface area and dynamic current value; however, it is preferable to make the carrier by using sinter obtained by sintering magnetic particles in the present invention. The following description will discuss a case in which the carrier of the present invention comprises the sinter.

Each of carrier particles constituting the carrier containing sinter of magnetic particles is formed by sintering and combining a plurality of magnetic particles, and more specifically, is constituted by a plurality of adjacent magnetic particles that are integrally combined with pores communicating with outer air. In other words, each of the carrier particles has a structure in which a plurality of magnetic particles are connected to each other at their contact portions so as to be integrally formed into a porous structure. The carrier without such porosity is not preferable because the control of the carrier BET specific area to the above-mentioned area causes an extreme reduction in the carrier average particle size.

The carrier comprising sinter of magnetic particles may be prepared by any method as long as the carrier having the above-mentioned BET specific surface area and dynamic current value is obtained; however, it is preferable to melt and knead (melt-knead) at least magnetic particles and a resin, pulverize the kneaded material, and sinter the resulting pulverized material.

More specifically, first, at least magnetic particles and a resin are mixed, and the mixture is melted and kneaded. With respect to the resin mixed with the magnetic particles, any known resin may be used as long as it is carbonized and eliminated through defatting and sintering processes, which will be described later, and can be melt-kneaded. More specifically, examples thereof include polyester resins and (meth)acrylate-based resins.

With respect to the magnetic particles, any known magnetic material may be used as long as it exhibits magnetic properties; and examples thereof include magnetite and ferrite.

It is preferable for the magnetic particles to contain a metal other than iron in its surface layer. The magnetic particle containing a metal other than iron in its surface layer is constituted by a core portion and the surface layer portion; and any known magnetic material may be used as the core portion, and the surface layer is made of a metal other than iron. In other words, the magnetic particle containing the metal other than iron in its surface layer is provided with a crystal phase in which the metal other than iron is co-precipitated, on the surface of the core portion made from the magnetic material. The application of such a magnetic particle makes it possible to properly adjust the carrier surface resistance, and consequently to effectively reduce the carrier consumption. More specifically, the carrier surface resistance is effectively raised so that it is possible to effectively achieve a reduction in the carrier consumption.

A magnetite particle containing a metal other than iron in its surface layer is used as the magnetic particle. The magnetite particle containing the metal other than iron in its surface layer is constituted by a magnetite core portion and a surface layer portion, and the surface layer contains the metal other than iron. In other words, the magnetite particle is provided with a magnetite crystal phase in which the metal other than iron is co-precipitated on the surface of the magnetite core portion.

The magnetite core portion has a spinel type structure in the same manner as known magnetite conventionally used in the two-component developer, and is represented by a general formula: $Fe_3O_4$.

The surface layer, formed on the surface of the magnetite core portion, has a structure in which the metal other than iron is co-precipitated in the $Fe_3O_4$ (magnetite) crystal lattice. Here, the co-precipitation refers to the fact that metal atoms other than iron atoms are captured in the $Fe_3O_4$ crystal lattice. With respect to the state in which the metal atoms other than iron atoms exist in the $Fe_3O_4$ crystal lattice, it is not particularly limited, as long as the metal atoms other than iron atoms exist in the $Fe_3O_4$ crystal lattice; and for example, it may be a substitution type state (mixed crystal state) in which iron atoms at inherent positions are substituted by the metal atoms other than iron atoms, or an interstitial type state in which atoms of the metal other than iron atoms are located in spaces within the $Fe_3O_4$ crystal lattice. In the mixed crystal state, the atoms of the metal other than iron atoms may be substituted by iron atoms in the crystal lattice in an irregular manner or in a regular manner.

With respect to "a metal other than iron", although not particularly limited, for example, one or not less than two metals selected from the group consisting of aluminum, magnesium, zinc, manganese, silica, nickel, cobalt, copper, and cadmium, are used. Among these metals, aluminum, magnesium and zinc are preferably used, and from the environmental standpoint, aluminum and magnesium are more preferably used.

In the magnetite particle containing a metal other than iron in its surface layer (hereinafter, referred to as "metal-containing magnetite particle"), a content of the metal atoms other than iron atoms is preferably set in the range of 0.01 to 10.00 mol%, preferably, 2.0 to 5.0 mol% with respect to all the number of metal atoms existing in the metal-containing magnetite particle.

In the surface layer containing the metal other than iron, a content of the metal atoms other than iron atoms is preferably set in the range of 1.0 to 80 mol%, preferably, 20 to 65 mol% with respect to all the number of metal atoms existing in the surface layer. Here, the thickness of the surface layer made of the co-precipitated metal other than iron is not particularly limited as long as a metal other than iron is co-precipitated on the uppermost surface of the metal-containing magnetite particle; and in general, it is set in the range of 5 to 50 nm, preferably, 10 to 30 nm.

With respect to the above-mentioned metal-containing magnetite particle, any manufacturing method may be used as long as it allows the metal other than iron to be co-precipitated on the uppermost surface of the resulting magnetite particle. For example, after having been obtained magnetite particles by using a known method, an aqueous solution (mixed solution) containing a compound of the metal other than iron and a ferrous salt is added to its reaction system, and this is oxidized by introducing an air flow thereto, and then dehydrated to obtain metal-containing magnetite particles. Commercially available magnetite particles may be added to an aqueous solution (mixed solution) containing a compound of the metal other than iron and a ferrous salt, and this is oxidized by introducing an air flow thereto, and then dehydrated to obtain metal containing magnetite particles.

More specifically, first, the ferrous salt aqueous solution is mixed with an alkali aqueous solution so as to form ferrous hydroxide, and the resulting slurry of ferrous hydroxide is maintained at a temperature in the range of 60 to 100° C., preferably 80 to 90° C., and then oxidized by introducing an air flow thereto (first oxidizing process). Then, to this reactant is added an aqueous solution (mixed solution) containing a compound of the metal other than iron and a ferrous salt, and while maintained at a predetermined temperature, this is again oxidized by introducing an air flow thereto (second oxidizing process). Then, the resulting precipitate is dried under an nitrogen atmosphere or an inert gas atmosphere, thereby obtaining metal-containing magnetite particles.

The material ferrous salt is not particularly limited as long as it is a water-soluble compound, and for example, ferrous sulfate may be used. The ferrous salt used in the first oxidizing process may be a compound different from that of a ferrous salt used in the second oxidizing process; however, it is preferable to use the same compound. Moreover, the compound of the metal other than iron is not particularly limited, as long as it is dissolved in the system; and for example, aluminum sulfate, magnesium sulfate, zinc sulfate, etc. may be used. The alkali aqueous solution is not particularly limited, as long as it allows isolated ferrous ions to precipitate as ferrous hydroxide; and for example, an aqueous solution of sodium hydroxide, etc. may be used.

A concentration and amount of use of the aqueous solution of ferrous salt and alkaline solution used in the first oxidizing process are not particularly limited, as long as an alkali concentration is not less than equivalent, that is, as long as all the ferrous irons in the system can be converted to ferrous hydroxide.

The ratio of composition of the metal-containing magnetite particles (the ratio of iron atoms (containing iron atoms of an oxidation number of 2 and iron atoms of an oxidation number of 3) and the metal atoms other than iron toms) corresponds to the number of iron atoms used as the material and the number of the metal atoms other than iron atoms, corresponding to the ratio of loads thereof. For this reason, "the ratio of content of the metal atoms other than iron atoms with respect to all the metal atoms in the metal-containing magnetite particles" is represented by "the ratio of the number of the metal atoms other than iron atoms used in the second oxidizing process to the addition of the number of iron atoms and the number of the metal atoms other than iron atoms that have been used in the first oxidizing process and the second oxidizing process". In the above-mentioned manufacturing method of the metal-containing magnetite particles, the core portion of the metal-containing magnetite particle is formed in the first oxidizing process, and the surface layer containing the metal other than iron is formed in the second oxidizing process; therefore, "the ratio of content of the number of the metal atoms other than iron atoms to the number of all the metal atoms in the surface layer of the metal-containing magnetite particle" is represented by "the ratio of the number of the metal atoms other than iron atoms used in the second oxidizing process to the total of the number of iron atoms and the number of the metal atoms other than iron atoms that have been used in the second oxidizing process".

An average primary particle size of the magnetic particles used in the present invention is preferably set in the range of 0.01 to 1 $\mu$m, preferably 0.1 to 0.5 $\mu$m. An amount of use of the magnetic particles is preferably set in the range of 640 to 1500 parts by weight with respect to 100 parts by weight of resin and more preferably, 700 to 1200 parts by weight.

With respect to the condition at the time of melt-kneading the mixture of the magnetic particles and a resin, it is not particularly limited, as long as the magnetic particles are uniformly dispersed in the resin, and in particular, the melt temperature is properly selected depending on the softening point of the resin to be used.

It is preferable to mix wax, etc. together with the magnetic particles and the resin. The application of wax makes it possible to easily knead, and consequently to improve the processability greatly. With respect to the wax, for example, San Wax 151P (made by Sanyo Kasei Kogyo K.K.), etc. may be used. An amount of use of the wax is preferably set in the range of 50 to 200 parts by weight with respect to 100 parts by weight of the resin.

After the resulting kneaded material has been cooled off, this is pulverized. In the pulverizing process, it is preferable to carry out a fine pulverizing process after a coarse pulverizing process. In the present invention, after the pulverizing process, a classifying process is preferably carried out. Thus, it becomes possible to uniformly set the particle size of the carrier particles with ease.

The particle size of the pulverized material is almost correctly reflected to the particle size of the carrier finally obtained so that the average particle size of the pulverized material is preferably controlled to the average particle size of the carrier, which will be described later. The average particle size of the pulverized material is preferably controlled by properly setting factors, such as the type of a pulverizing device, the pulverizing conditions and classifying conditions.

The pulverized material thus obtained is sintered. In the present invention, it is preferable to carry out a defatting (de-resin) process prior to the sintering process of the pulverized material. The defatting process makes it possible to eliminate most of the resin in the pulverized particles. By carrying out the defatting process prior to the sintering process, it is possible to effectively prevent the occurrence of cracks due to expansion of the resin that would take place in the case of the sintering process without being preceded by the defatting process. The occurrence of cracks raises the problem of a reduction in the mechanical strength. The defatting process is not particularly limited, as long as the resin in the pulverized particles is burnt and eliminated to an extent that can prevent the above-mentioned problem, and is preferably carried out by maintaining it for a predetermined time, preferably for approximately 20 hours, in air, preferably in a vacuum, in the process during which the temperature is raised so as to carry out the sintering process which will be described later. The defatting temperature is not particularly limited, as long as it is in a range that allows the resin to be carbonized and burnt away.

The sintering conditions are not particularly limited, as long as the magnetic particles in the pulverized particles are combined by the sintering process and the resulting sintered material is sintered in such a manner that pores communicating with outer air are formed therein. In the present invention, for example, in the case of the application of magnetite as the magnetic particles, the sintering process is preferably achieved by maintaining the pulverized matter under a nitrogen gas atmosphere or an inert gas atmosphere at a temperature in the range of 1,000 to 1,300° C., preferably 1050 to 1200° C., for 2 to 6 hours, preferably 3 to 5 hours. The sintering process carried out under the above-mentioned atmosphere makes it possible to prevent the resulting sintered material from being oxidized, and also to control the dynamic current value of the carrier to the above-mentioned range. In the case when the sintering process is carried out under stronger conditions in such a manner that no pores communicating with outer air are formed, it becomes impossible to control the carrier BET specific surface area to the aforementioned range while maintaining a proper carrier particle size.

After the sintering process, the sintered material is in an aggregated state; therefore, this is pulverized. After the pulverizing process, a classifying process is carried out, if necessary. The pulverizing conditions and the classifying conditions are preferably set so that the resulting carrier particles have an average particle size of 20 to 80 $\mu$m, preferably 20 to 50 $\mu$m, more preferably 20 to 40 $\mu$m. The average particle size of the carrier particles is defined as the average value of the longest lengths of particle sizes that is confirmed when the particles are observed under an electronic microscope (×1000).

The carrier obtained as described above, as it is, is mixed with a toner, and applied; thus, it becomes possible to prevent the occurrence of fog and lead-off on a copied image for a long time, and consequently to reduce carrier consumption. In the present invention, the sintered matter may be used as the coat-type carrier formed by coating the sintered particles with a coating resin, or as the binder-type carrier formed by dispersing the sintered particles in a binder resin.

The toner which is mixed with the carrier of the present invention preferably has a negative chargeability. In the case when the toner to be added has a positive chargeability, it is preferable to apply a surface treatment to the carrier by using a treatment agent such as a fluororesin-based treatment agent.

The toner, which constitutes a two-component developer in combination with the carrier of the present invention, may be prepared by using any method. For example, any known granulating method for toner particles, such as a pulverizing method, emulsion dispersing method, emulsion polymerization method, or suspension polymerization method, may be used; and the method is not particularly limited. In the present invention, from the viewpoint of manufacturing costs and ease in preparation, it is preferable to use a pulverizing method, that is, more particularly, a method in which at least a toner binder resin and a colorant are mixed and melt-kneaded, and this is then coarsely pulverized and finely pulverized, and then classified. With respect to the toner binder resin and the colorant, any known resin and colorant that are conventionally used in the field of electrophotographing toners may be used, and in particular, with respect to the colorant, any known colored pigment and dye that can be used in full-color toners, such as black, yellow, red and blue pigments and dyes, may be used.

If desired, an additive agent, such as a charge-control agent, a mold-releasing material and magnetic particles, may be further contained in the toner. With respect to these additive agents, any known material that has been conventionally used in the field of electrophotographing toners may be adopted.

The average particle size of the toner is not particularly limited; and it is generally set in the range of 5 to 14 $\mu$m, preferably 6 to 10 $\mu$m.

From the viewpoint of developing properties and chargeability, a ratio of toner-mixing weight in the two-component developer is preferably set in the range of 6 to 16 weight %, preferably 10 to 13 weight %.

The following description will discuss the present invention in more detail by means of examples.

EXAMPLES

Examples of Production of Magnetic Particles (Magnetic particles A)

An aqueous solution of ferrous sulfate (1.54 mol/L)(65L) and an aqueous solution of sodium hydroxide (2.38 mol/L) (88L) were mixed to form ferrous hydroxide. The resulting ferrous hydroxide slurry was maintained at 85° C., and to this was introduced an air flow so as to be oxidized (first oxidizing process). To this reactant was added a mixed solution (2.25L) of an aqueous solution of aluminum sulfate and an aqueous solution of ferrous sulfate, and while this was maintained at 85° C., to this was again introduced an air flow so as to be oxidized (second oxidizing process). The resulting precipitate was dehydrated to obtain magnetic particles A. In the mixed solution of the aqueous solution of aluminum sulfate and the aqueous solution of ferrous sulfate that had been added in the second oxidizing process, the concentration of the aluminum sulfate was 0.69 mol/L, and the concentration of the ferrous sulfate was 1.14 mol/L. The ratio of the number of the metal atoms other than iron atoms to the number of all the metal atoms in the resulting magnetic particles and the ratio of the number of the metal atoms other than iron atoms to the number of all the metal atoms in the surface layer of the magnetic particle were calculated from the concentrations of the materials used and the amounts of use, and the resulting values, 2.94 mol% and 54.8 mol%, were respectively obtained.

(Magnetic particles B and C)

The same preparation method as magnetic particles A was carried out except that the concentration of "the compound of the metal other than iron" was changed as described in Table 1 so that magnetic particles B and C were obtained. The ratio of the number of the metal atoms other than iron atoms to the number of all the metal atoms in the resulting magnetic particles and the ratio of the number of the metal atoms other than iron atoms to the number of all the metal atoms in the surface layer of the magnetic particle were calculated, and the results are shown in Table 1 together with preparation conditions.

TABLE 1

| | First oxidizing process | | | | Second oxidizing process | | | | | | |
|---|---|---|---|---|---|---|---|---|---|---|---|
| | Aqueous solution of ferrous sulfate | | Aqueous solution of sodium hydroxide | | Mixed solution | | | | | | |
| | | | | | Compound of metal other than iron | | | | | | |
| Type of magnetic particle | Concentration (mol/L) | Amount of liquid (L) | Concentration (mol/L) | Amount of liquid (L) | Type | Concentration* (mol/L) | Concentration* of ferrous sulfate (mol/L) | Amount of liquid (L) | Ratio of metal atoms other than iron atoms in magnetic particles** (mol %) | Ratio of metal atoms other than iron atoms in surface layer of magnetic particles*** (mol %) | Average particle size of magnetic particles ($\mu$m) |
| A | 1.54 | 65 | 2.38 | 88 | Aluminum sulfate | 0.69 | 1.14 | 2.25 | 2.94 | 54.8 | 0.25 |
| B | 1.54 | 65 | 2.38 | 88 | Aluminum sulfate | 0.81 | 1.14 | 2.25 | 3.43 | 58.7 | 0.25 |
| C | 1.54 | 65 | 2.38 | 88 | Aluminum sulfate | 0.93 | 1.14 | 2.25 | 3.92 | 62.0 | 0.25 |

TABLE 1-continued

| | First oxidizing process | | | | Second oxidizing process | | | | | | |
|---|---|---|---|---|---|---|---|---|---|---|---|
| | Aqueous solution of ferrous sulfate | | Aqueous solution of sodium hydroxide | | Mixed solution | | | | | | |
| Type of magnetic particle | Concentration (mol/L) | Amount of liquid (L) | Concentration (mol/L) | Amount of liquid (L) | Compound of metal other than iron Type | Concentration* (mol/L) | Concentration* of ferrous sulfate (mol/L) | Amount of liquid (L) | Ratio of metal atoms other than iron atoms in magnetic particles** (mol %) | Ratio of metal atoms other than iron atoms in surface layer of magnetic particles*** (mol %) | Average particle size of magnetic particles (μm) |

*Concentration in a mixed solution
**Ratio of the number of metal atoms other than iron atoms to the number of all the metal atoms in magnetic particles
***Ratio of the number of metal atoms other than iron atoms to the number of all the metal atoms in layer of magnetic particles

Example of Production of Carriers

| (Carrier A) | parts by weight |
|---|---|
| Resin (made by Kao K.K.; Tafton NE1110) | 50 |
| Magnetic particles (made by Titan Kogyo K.K.; BL-50 502AE, $1.6 \times 10^8 \Omega \cdot cm$) | 600 |
| Additive (made by Sanyo Kasei K.K.; San Wax 151P) | 50 |

The above-mentioned ingredients were sufficiently mixed in Henschel mixer, and then melt-kneaded in a bent twin-screw extruder kneader, and this was coarsely pulverized by a feather mill, and then finely pulverized by a mechanical pulverizer. The resulting finely pulverized material was defatted and sintered, and then pulverized and classified to give carrier A having an average particle size of 30 μm.

| (Carrier B) | parts by weight |
|---|---|
| Resin (made by Kao K.K.; Tafton NE1110) | 50 |
| Magnetic particles (made by Titan Kogyo K.K.; BL-50 502AE, $1.6 \times 10^8 \Omega \cdot cm$) | 500 |
| Additive (made by Sanyo Kasei K.K.; San Wax 151P) | 50 |

The same preparation process as that of carrier A was carried out, except that the above-mentioned ingredients were used, thereby obtaining carrier B having an average particle size of 30 μm.

| (Carrier C) | parts by weight |
|---|---|
| Resin (made by Kao K.K.; Tafton NE1110) | 50 |
| Magnetic particles (made by Titan Kogyo K.K.; BL-50 502AE, $1.6 \times 10^8 \Omega \cdot cm$) | 350 |
| Additive (made by Sanyo Kasei K.K.; San Wax 151P) | 50 |

The same preparation process as that of carrier A was carried out, except that the above-mentioned ingredients were used, thereby obtaining carrier C having an average particle size of 30 μm.

| (Carrier D) | parts by weight |
|---|---|
| Resin (made by Kao K.K.; Tafton NE1110) | 50 |
| Magnetic particles (magnetic particle A, $8.0 \times 10^8 \Omega \cdot cm$) | 500 |
| Additive (made by Sanyo Kasei K.K.; San Wax 151P) | 50 |

The same preparation process as that of carrier A was carried out, except that the above-mentioned ingredients were used, thereby obtaining carrier D having an average particle size of 30 μm.

| (Carrier E) | parts by weight |
|---|---|
| Resin (made by Kao K.K.; Tafton NE1110) | 50 |
| Magnetic particles (magnetic particle B, $1.03 \times 10^{10} \Omega \cdot cm$) | 600 |
| Additive (made by Sanyo Kasei K.K.; San Wax 151P) | 50 |

The same preparation process as that of carrier A was carried out, except that the above-mentioned ingredients were used, thereby obtaining carrier E having an average particle size of 30 μm.

| (Carrier F) | parts by weight |
|---|---|
| Resin (made by Kao K.K.; Tafton NE1110) | 50 |
| Magnetic particles (magnetic particle B, $1.03 \times 10^{10} \Omega \cdot cm$) | 500 |
| Additive (made by Sanyo Kasei K.K.; San Wax 151P) | 50 |

The same preparation process as that of carrier A was carried out, except that the above-mentioned ingredients were used, thereby obtaining carrier F having an average particle size of 30 μm.

| (Carrier G) | parts by weight |
|---|---|
| Resin (made by Kao K.K.; Tafton NE1110) | 50 |
| Magnetic particles (magnetic particle B, $1.03 \times 10^{10} \Omega \cdot cm$) | 400 |
| Additive (made by Sanyo Kasei K.K.; San Wax 151P) | 50 |

The same preparation process as that of carrier A was carried out, except that the above-mentioned ingredients were used, thereby obtaining carrier G having an average particle size of 30 $\mu$m.

| (Carrier H) | parts by weight |
|---|---|
| Resin (made by Kao K.K.; Tafton NE1110) | 50 |
| Magnetic particles (magnetic particle B, $1.03 \times 10^{10}\Omega \cdot$ cm) | 350 |
| Additive (made by Sanyo Kasei K.K.; San Wax 151P) | 50 |

The same preparation process as that of carrier A was carried out, except that the above-mentioned ingredients were used, thereby obtaining carrier H having an average particle size of 30 $\mu$m.

| (Carrier I) | parts by weight |
|---|---|
| Resin (made by Kao K.K.; Tafton NE1110) | 50 |
| Magnetic particles (magnetic particle C, $2.05 \times 10^{11}\Omega \cdot$ cm) | 600 |
| Additive (made by Sanyo Kasei K.K.; San Wax 151P) | 50 |

The same preparation process as that of carrier A was carried out, except that the above-mentioned ingredients were used, thereby obtaining carrier I having an average particle size of 30 $\mu$m.

| (Carrier J) | parts by weight |
|---|---|
| Resin (made by Kao K.K.; Tafton NE1110) | 50 |
| Magnetic particles (magnetic particle C, $2.05 \times 10^{11}\Omega \cdot$ cm) | 350 |
| Additive (made by Sanyo Kasei K.K.; San Wax 151P) | 50 |

The same preparation process as that of carrier A was carried out, except that the above-mentioned ingredients were used, thereby obtaining carrier J having an average particle size of 30 $\mu$m.

| (Carrier K) | parts by weight |
|---|---|
| Resin (made by Kao K.K.; Tafton NE1110) | 50 |
| Magnetic particles (magnetic particle B, $1.03 \times 10^{10}\Omega \cdot$ cm) | 800 |
| Additive (made by Sanyo Kasei K.K.; San Wax 151P) | 50 |

The same preparation process as that of carrier A was carried out, except that the above-mentioned ingredients were used, thereby obtaining carrier K having an average particle size of 30 $\mu$m.

| (Carrier L) | parts by weight |
|---|---|
| Resin (made by Kao K.K.; Tafton NE1110) | 50 |
| Magnetic particles (magnetic particle B, $1.03 \times 10^{10}\Omega \cdot$ cm) | 300 |
| Additive (made by Sanyo Kasei K.K.; San Wax 151P) | 50 |

The same preparation process as that of carrier A was carried out, except that the above-mentioned ingredients were used, thereby obtaining carrier L having an average particle size of 30 $\mu$m.

| (Carrier M) | parts by weight |
|---|---|
| Resin (made by Kao K.K.; Tafton NE1110) | 50 |
| Magnetic particles (magnetic particle B, $1.03 \times 10^{10}\Omega \cdot$ cm) | 250 |
| Additive (made by Sanyo Kasei K.K.; San Wax 151P) | 50 |

The same preparation process as that of carrier A was carried out, except that the above-mentioned ingredients were used, thereby obtaining carrier M having an average particle size of 30 $\mu$m.

| (Carrier N) | parts by weight |
|---|---|
| Resin (made by Kao K.K.; Tafton NE1110) | 50 |
| Magnetic particles (made by Titan Kogyo K.K.; PB-18SAE, $1.0 \times 10^{8}\Omega \cdot$ cm) | 800 |
| Additive (made by Sanyo Kasei K.K.; San Wax 151P) | 50 |

The same preparation process as that of carrier A was carried out, except that the above-mentioned ingredients were used, thereby obtaining carrier N having an average particle size of 30 $\mu$m.

| (Carrier O) | parts by weight |
|---|---|
| Resin (made by Kao K.K.; Tafton NE1110) | 50 |
| Magnetic particles (made by Titan Kogyo K.K.; PB-18SAE, $1.0 \times 10^{8}\Omega \cdot$ cm) | 500 |
| Additive (made by Sanyo Kasei K.K.; San Wax 151P) | 50 |

The same preparation process as that of carrier A was carried out, except that the above-mentioned ingredients were used, thereby obtaining carrier O having an average particle size of 30 $\mu$m.

| (Carrier P) | parts by weight |
|---|---|
| Resin (made by Kao K.K.; Tafton NE1110) | 50 |
| Magnetic particles (made by Titan Kogyo K.K.; PB-18SAE, $1.0 \times 10^{8}\Omega \cdot$ cm) | 300 |
| Additive (made by Sanyo Kasei K.K.; San Wax 151P) | 50 |

The same preparation process as that of carrier A was carried out, except that the above-mentioned ingredients were used, thereby obtaining carrier P having an average particle size of 30 $\mu$m.

| (Carrier Q) | parts by weight |
|---|---|
| Resin (made by Kao K.K.; Tafton NE1110) | 50 |
| Magnetic particles (made by Titan Kogyo K.K.; BL-50 BR605) | 500 |
| Additive (made by Sanyo Kasei K.K.; San Wax 151P) | 50 |

After the above-mentioned ingredients had been sufficiently mixed in Henschel mixer, this mixture was melt-kneaded by a bent two-screw extruder kneader, and coarsely pulverized in a feather mill, and finely pulverized in a mechanical pulverizer. The resulting finely pulverized matter was classified and subjected to a heating treatment, thereby obtaining carrier Q having an average particle size of 30 $\mu$m.

Physical Properties of Carrier

The physical properties of the resulting carrier were measured by the following method.

(Dynamic current value (CDC value))

The dynamic current value of the carrier was measured by the above-mentioned method by using a device schematically shown in FIG. 1.

(BET specific surface area)

The BET specific surface area of the carrier was measured by using an NS-12 system (made by QUANTACHROME CORP.).

Table 2 shows the physical properties of the carriers.

TABLE 2

| | CDC value (nA) | BET specific surface area ($m^2/g$) |
|---|---|---|
| Carrier A | 148 | 0.56 |
| Carrier B | 146 | 0.75 |
| Carrier C | 149 | 1.8 |
| Carrier D | 130 | 0.81 |
| Carrier E | 65 | 0.54 |
| Carrier F | 56 | 0.79 |
| Carrier G | 51 | 1.01 |
| Carrier H | 49 | 1.72 |
| Carrier I | 25 | 0.52 |
| Carrier J | 26 | 1.77 |
| Carrier K | 50 | 0.49 |
| Carrier L | 53 | 2.09 |
| Carrier M | 48 | 2.04 |
| Carrier N | 191 | 0.47 |
| Carrier O | 182 | 0.78 |
| Carrier P | 175 | 2.02 |
| Carrier Q | 10 | 0.45 |

Examples 1 to 20 and Comparative Examples 1 to 14

Each of the above-mentioned carriers was mixed with toner 1 or toner 2, which will be described later, for one hour by using a roll mill, thereby obtaining a two-component developer. The mixing ratio of the toner in the developer was 13% by weight. The types of carriers and toners are shown in Table 3 and Table 4.

TABLE 3

| | Carrier type | Toner type |
|---|---|---|
| Example-1 | A | 1 |
| Example-2 | B | 1 |
| Example-3 | C | 1 |
| Example-4 | D | 1 |
| Example-5 | E | 1 |
| Example-6 | F | 1 |
| Example-7 | G | 1 |
| Example-8 | H | 1 |
| Example-9 | I | 1 |
| Example-10 | J | 1 |
| Comparative Example-1 | K | 1 |
| Comparative Example-2 | L | 1 |
| Comparative Example-3 | M | 1 |
| Comparative Example-4 | N | 1 |

TABLE 3-continued

| | Carrier type | Toner type |
|---|---|---|
| Comparative Example-5 | O | 1 |
| Comparative Example-6 | P | 1 |
| Comparative Example-7 | Q | 1 |

TABLE 4

| | Carrier type | Toner type |
|---|---|---|
| Example-11 | A | 2 |
| Example-12 | B | 2 |
| Example-13 | C | 2 |
| Example-14 | D | 2 |
| Example-15 | E | 2 |
| Example-16 | F | 2 |
| Example-17 | G | 2 |
| Example-18 | H | 2 |
| Example-19 | I | 2 |
| Example-20 | J | 2 |
| Comparative Example-8 | K | 2 |
| Comparative Example-9 | L | 2 |
| Comparative Example-10 | M | 2 |
| Comparative Example-11 | N | 2 |
| Comparative Example-12 | O | 2 |
| Comparative Example-13 | P | 2 |
| Comparative Example-14 | Q | 2 |

Examples of Production of Toners

| (Toner 1) | parts by weight |
|---|---|
| Thermoplastic polyester resin (softening point 120° C., glass transition point 61° C.) | 100 |
| Carbon black (Mogul L: made by Cabot Corp.) | 8 |
| Low molecular propylene (Viscol 550P: made by Sanyo Kasei Kogyo K.K.) | 3 |
| Negative charge-control agent (Bontron S-34: made by Orient Kagaku K.K.) | 5 |

The above-mentioned materials were sufficiently mixed, and then melt-kneaded by using a bent twin-screw extruder at 140° C. After having been cooled, this kneaded material was coarsely pulverized with a feather mill and successively finely pulverized with a jet mill, and this was classified with an air classifier; thus, black fine particles having a volume-average particle size of 9 $\mu$m were obtained. To 100 parts by weight of the black fine particles were added 0.3 parts by weight of hydrophobic silica (H-2000: made by Hoechst Japan Ltd.), and this was processed by Henschel mixer (Mitsui Miike Kakouki K.K.) at 1,000 rpm for one minute, thereby obtaining a negatively chargeable toner. The resulting toner is referred to as toner 1.

(Toner 2)

Polyester resin (softening point 100° C., glass transition point 58° C.) and magenta pigment (C.I. Pigment Red 184) were put into a pressure kneader so as to be set at a weight ratio of 7:3 (resin : pigment), and kneaded.

After cooled, the resulting kneaded material was pulverized by a feather mill, thereby obtaining a pigment master batch.

The above-mentioned polyester resin (93 parts by weight), 10 parts by weight of the master batch and 2 parts by weight of a zinc salicylate complex (E-84: Orient Kagaku K.K.) were subjected to the same processes as the production example of toner 1, thereby obtaining fine particles having a volume-average particle size of 8.5 $\mu$m. To 100 parts by weight of the fine particles were added 0.5 parts by weight of hydrophobic silica (H-2000: made by Hoechst Japan Ltd.) and 0.6 parts by weight of titanium oxide particles (STT-30A: made by Titan Kogyo K.K.), and this was processed by Henschel mixer at 1000 rpm for 1 minute, thereby obtaining a magenta toner. The resulting toner is referred to as toner 2.

EVALUATION

Each of the developers was loaded into a copying machine and subjected to continuous copying processes, and evaluation was made on carrier consumption, fog on an image, and lead-off on an image in the following methods. In the case of the developer using toner 1, Di-30 (made by Minolta K.K.) was used, and this was subjected to endurance copying processes of 300,000 sheets under N/N environment (25° C., 50%), and 150,000 sheets under H/H environment (30° C., 85%); thus, after predetermined number of copies had been made, the evaluation was made. In the case of the developer using toner 2, CF-900 (made by Minolta K.K.) was used, and this was subjected to endurance copying processes of 100,000 sheets under N/N environment (25° C., 50%), and 80,000 sheets under H/H environment (30° C., 85%); thus, after predetermined number of copies had been made, the evaluation was made.

Figure 2:
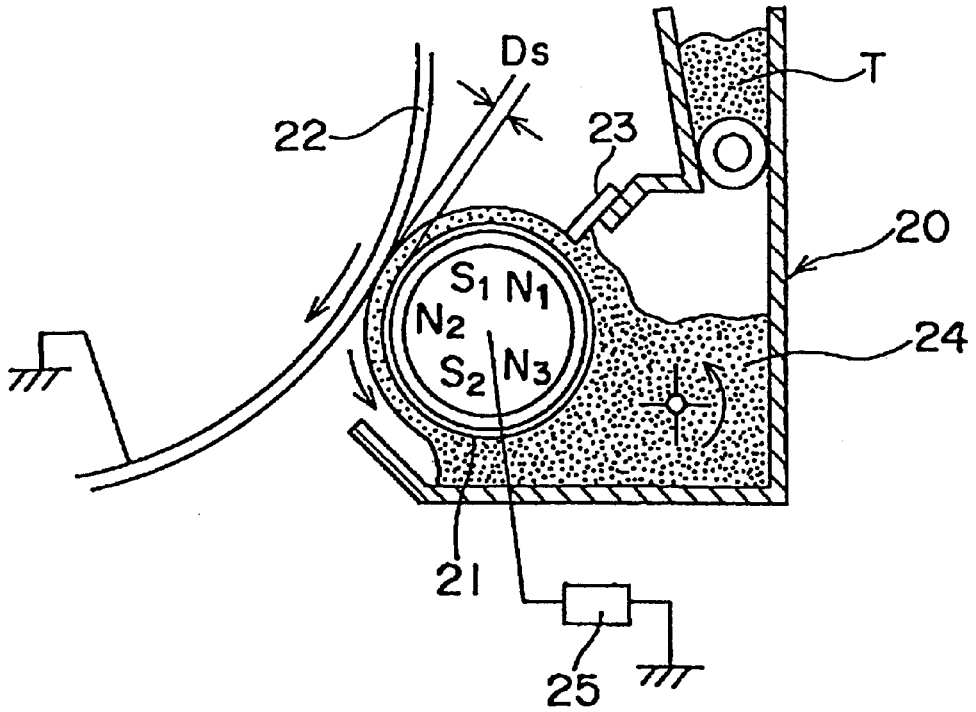
FIG. 2 is an explanatory view that schematically shows a developing device of a copying machine used in Examples.

Each of the copying machines had a developing device (20) having a structure as schematically shown in FIG. 2, and was modified as follows:

The gap between a developing sleeve (21) and a magnetic blade (23) was set to 0.4 mm so that the amount of transported developer (24) to the developing area by the developing sleeve (21) was adjusted to 5.0 mg/cm$^2$. The peripheral velocity of the photosensitive member (22) was set to 165 mm/s. The peripheral velocity of the developing sleeve (21) was set to 300 mm/s. The portion of the photosensitive member (22) to which toner T was supplied was set to have a surface electric potential of −450 V. The portion thereof to which toner T was not supplied was set to have a surface electric potential of −100 V. Ds was set to 0.35 mm. To the developing area at which the developing sleeve (21) and the photosensitive member (22) face each other was applied a developing bias voltage from a developing bias power supply (25) that was formed by multiplexing a dc voltage of −350 V and an ac voltage having a rectangular waveform with a peak-to-peak value $V_{p-p}$ of 1.5 kV, a frequency of 3 kHz, and a duty ratio (developing:collecting) of 1:1, so that reverse development was made.

(Amount of carrier consumption)

After a predetermined number of copies had been made, a toner image formed on the surface of the photosensitive member at the time of copying a solid black image (A-4 size) was collected, and the collected toner was burnt so that an amount of carrier consumption in the collected toner was measured. The measured value was multiplied by 1000 so as to represent the amount of carrier consumption. The evaluation was made based upon the following ranks:

◎: The amount of carrier consumption was less than 80 mg;

○: The amount of carrier consumption was in the range from not less than 80 mg to less than 100 mg (in which no problems arise in practical use);

Δ: The amount of carrier consumption was in the range from not less than 100 mg to less than 120 mg (in which problems arise in practical use); and x: The amount of carrier consumption was not less than 120 mg.

(Fog in images)

Copied images on white paper were checked for fog by a magnifying glass, and the evaluation was made based on the following ranks:

◎: No fog occurred;

○: Fog slightly occurred; however, no problem arose in practical use;

Δ: Fog was visually observed; to cause practical problems; and x: Fog occurred all over the image.

(Lead-off on images)

Copied images having solid squares in the half-tone background were observed under a magnifying glass, and evaluation was made based on the following ranks. The lead-off refers to a phenomenon in which upon copying an image having continuous areas with a comparatively high density and a comparatively low density for a long time, an image-less portion occurs in the border between the high-density area and the low-density area on the copied image.

◎: No lead-off occurred;

○: Lead-off slightly occurred; however, no problem arose in practical use;

Δ: Lead-off was visually observed; therefore, problems arose in practical use; and X: Lead-off was noticeable.

The results of the above-mentioned evaluation are shown in Tables 5 to 10.

TABLE 5

(1) Amount of carrier consumption (Unit: ×10,000)

| Environment | N/N | N/N | N/N | N/N | H/H | N/N | N/N | H/H | N/N | N/N | N/N |
|---|---|---|---|---|---|---|---|---|---|---|---|
| Number of copies | Initial state | 1 | 3 | 5 | 6 | 8 | 10 | 15 | 20 | 25 | 30 |
| Example 1 | ◎ | ◎ | ◎ | ◎ | ◎ | ◎ | ◎ | ◎ | ◎ | ○ | ○ |
| Example 2 | ◎ | ◎ | ◎ | ◎ | ◎ | ◎ | ◎ | ◎ | ◎ | ○ | ○ |
| Example 3 | ◎ | ◎ | ◎ | ◎ | ◎ | ◎ | ◎ | ◎ | ◎ | ○ | ○ |
| Example 4 | ◎ | ◎ | ◎ | ◎ | ◎ | ◎ | ◎ | ◎ | ◎ | ◎ | ○ |
| Example 5 | ◎ | ◎ | ◎ | ◎ | ◎ | ◎ | ◎ | ◎ | ◎ | ◎ | ◎ |
| Example 6 | ◎ | ◎ | ◎ | ◎ | ◎ | ◎ | ◎ | ◎ | ◎ | ◎ | ◎ |
| Example 7 | ◎ | ◎ | ◎ | ◎ | ◎ | ◎ | ◎ | ◎ | ◎ | ◎ | ◎ |
| Example 8 | ◎ | ◎ | ◎ | ◎ | ◎ | ◎ | ◎ | ◎ | ◎ | ◎ | ◎ |
| Example 9 | ◎ | ◎ | ◎ | ◎ | ◎ | ◎ | ◎ | ◎ | ◎ | ◎ | ◎ |
| Example 10 | ◎ | ◎ | ◎ | ◎ | ◎ | ◎ | ◎ | ◎ | ◎ | ◎ | ◎ |
| Comparative | ◎ | ◎ | ◎ | ◎ | ○ | Δ | X | X | X | X | X |

TABLE 5-continued (1) Amount of carrier consumption (Unit: ×10,000)

| Environment<br>Number of copies | N/N<br>Initial state | N/N<br>1 | N/N<br>3 | N/N<br>5 | H/H<br>6 | N/N<br>8 | N/N<br>10 | H/H<br>15 | N/N<br>20 | N/N<br>25 | N/N<br>30 |
|---|---|---|---|---|---|---|---|---|---|---|---|
| Example 2 | | | | | | | | | | | |
| Comparative Example 3 | ⊙ | ⊙ | ⊙ | ⊙ | ○ | Δ | X | X | X | X | X |
| Comparative Example 4 | X | X | X | X | X | X | X | X | X | X | X |
| Comparative Example 5 | X | X | X | X | X | X | X | X | X | X | X |
| Comparative Example 6 | X | X | X | X | X | X | X | X | X | X | X |

TABLE 6

(1) Amount of carrier consumption (Unit: ×10,000)

| Environment<br>Number of copies | N/N<br>Initial state | N/N<br>1 | N/N<br>3 | N/N<br>4 | H/H<br>5 | N/N<br>6 | N/N<br>7 | H/H<br>8 | N/N<br>9 | N/N<br>10 |
|---|---|---|---|---|---|---|---|---|---|---|
| Example 11 | ⊙ | ⊙ | ⊙ | ⊙ | ⊙ | ⊙ | ⊙ | ○ | ○ | ○ |
| Example 12 | ⊙ | ⊙ | ⊙ | ⊙ | ⊙ | ⊙ | ⊙ | ○ | ○ | ○ |
| Example 13 | ⊙ | ⊙ | ⊙ | ⊙ | ⊙ | ⊙ | ⊙ | ○ | ○ | ○ |
| Example 14 | ⊙ | ⊙ | ⊙ | ⊙ | ⊙ | ⊙ | ⊙ | ⊙ | ○ | ○ |
| Example 15 | ⊙ | ⊙ | ⊙ | ⊙ | ⊙ | ⊙ | ⊙ | ⊙ | ⊙ | ⊙ |
| Example 16 | ⊙ | ⊙ | ⊙ | ⊙ | ⊙ | ⊙ | ⊙ | ⊙ | ⊙ | ⊙ |
| Example 17 | ⊙ | ⊙ | ⊙ | ⊙ | ⊙ | ⊙ | ⊙ | ⊙ | ⊙ | ⊙ |
| Example 18 | ⊙ | ⊙ | ⊙ | ⊙ | ⊙ | ⊙ | ⊙ | ⊙ | ⊙ | ⊙ |
| Example 19 | ⊙ | ⊙ | ⊙ | ⊙ | ⊙ | ⊙ | ⊙ | ⊙ | ⊙ | ⊙ |
| Example 20 | ⊙ | ⊙ | ⊙ | ⊙ | ⊙ | ⊙ | ⊙ | ⊙ | ⊙ | ⊙ |
| Comparative Example 9 | ⊙ | ⊙ | ⊙ | ⊙ | ○ | Δ | X | X | X | X |
| Comparative Example 10 | ⊙ | ⊙ | ⊙ | ⊙ | ○ | Δ | X | X | X | X |
| Comparative Example 11 | X | X | X | X | X | X | X | X | X | X |
| Comparative Example 12 | X | X | X | X | X | X | X | X | X | X |
| Comparative Example 13 | X | X | X | X | X | X | X | X | X | X |

TABLE 7

(2) Fog evaluation (Unit: ×10,000)

| Environment<br>Number of copies | N/N<br>Initial state | N/N<br>1 | N/N<br>3 | N/N<br>5 | H/H<br>6 | N/N<br>8 | N/N<br>10 | H/H<br>15 | N/N<br>20 | N/N<br>25 | N/N<br>30 |
|---|---|---|---|---|---|---|---|---|---|---|---|
| Example 1 | ⊙ | ⊙ | ⊙ | ⊙ | ⊙ | ⊙ | ⊙ | ⊙ | ⊙ | ○ | ○ |
| Example 2 | ⊙ | ⊙ | ⊙ | ⊙ | ⊙ | ⊙ | ⊙ | ⊙ | ⊙ | ○ | ○ |
| Example 3 | ⊙ | ⊙ | ⊙ | ⊙ | ⊙ | ⊙ | ⊙ | ⊙ | ⊙ | ⊙ | ⊙ |
| Example 4 | ⊙ | ⊙ | ⊙ | ⊙ | ⊙ | ⊙ | ⊙ | ⊙ | ⊙ | ○ | ○ |
| Example 5 | ⊙ | ⊙ | ⊙ | ⊙ | ⊙ | ⊙ | ⊙ | ⊙ | ⊙ | ○ | ○ |
| Example 6 | ⊙ | ⊙ | ⊙ | ⊙ | ⊙ | ⊙ | ⊙ | ⊙ | ⊙ | ○ | ○ |
| Example 7 | ⊙ | ⊙ | ⊙ | ⊙ | ⊙ | ⊙ | ⊙ | ⊙ | ⊙ | ⊙ | ○ |
| Example 8 | ⊙ | ⊙ | ⊙ | ⊙ | ⊙ | ⊙ | ⊙ | ⊙ | ⊙ | ⊙ | ⊙ |
| Example 9 | ⊙ | ⊙ | ⊙ | ⊙ | ⊙ | ⊙ | ⊙ | ⊙ | ⊙ | ○ | ○ |
| Example 10 | ⊙ | ⊙ | ⊙ | ⊙ | ⊙ | ⊙ | ⊙ | ⊙ | ⊙ | ⊙ | ⊙ |
| Comparative Example 1 | ⊙ | ⊙ | ⊙ | ⊙ | ⊙ | ⊙ | ○ | Δ | X | X | X |
| Comparative | ⊙ | ⊙ | ⊙ | ⊙ | ⊙ | ⊙ | ○ | Δ | X | X | X |

TABLE 7-continued (2) Fog evaluation (Unit: ×10,000)

| Environment<br>Number of copies | N/N<br>Initial state | N/N<br>1 | N/N<br>3 | N/N<br>5 | H/H<br>6 | N/N<br>8 | N/N<br>10 | H/H<br>15 | N/N<br>20 | N/N<br>25 | N/N<br>30 |
|---|---|---|---|---|---|---|---|---|---|---|---|
| Example 4 | | | | | | | | | | | |
| Comparative Example 7 | ◎ | ◎ | ◎ | ◎ | ◎ | ◎ | ○ | Δ | X | X | X |

TABLE 8

(2) Fog evaluation (Unit: ×10,000)

| Environment<br>Number of copies | N/N<br>Initial state | N/N<br>1 | N/N<br>3 | N/N<br>4 | H/H<br>5 | N/N<br>6 | N/N<br>7 | H/H<br>8 | N/N<br>9 | N/N<br>10 |
|---|---|---|---|---|---|---|---|---|---|---|
| Example 11 | ◎ | ◎ | ◎ | ◎ | ◎ | ◎ | ◎ | ◎ | ○ | ○ |
| Example 12 | ◎ | ◎ | ◎ | ◎ | ◎ | ◎ | ◎ | ◎ | ○ | ○ |
| Example 13 | ◎ | ◎ | ◎ | ◎ | ◎ | ◎ | ◎ | ◎ | ◎ | ◎ |
| Example 14 | ◎ | ◎ | ◎ | ◎ | ◎ | ◎ | ◎ | ◎ | ○ | ○ |
| Example 15 | ◎ | ◎ | ◎ | ◎ | ◎ | ◎ | ◎ | ◎ | ○ | ○ |
| Example 16 | ◎ | ◎ | ◎ | ◎ | ◎ | ◎ | ◎ | ◎ | ○ | ○ |
| Example 17 | ◎ | ◎ | ◎ | ◎ | ◎ | ◎ | ◎ | ◎ | ◎ | ○ |
| Example 18 | ◎ | ◎ | ◎ | ◎ | ◎ | ◎ | ◎ | ◎ | ◎ | ◎ |
| Example 19 | ◎ | ◎ | ◎ | ◎ | ◎ | ◎ | ◎ | ◎ | ○ | ○ |
| Example 20 | ◎ | ◎ | ◎ | ◎ | ◎ | ◎ | ◎ | ◎ | ◎ | ◎ |
| Comparative Example 8 | ◎ | ◎ | ◎ | ◎ | ◎ | ○ | Δ | X | X | X |
| Comparative Example 11 | ◎ | ◎ | ◎ | ◎ | ◎ | ○ | Δ | X | X | X |
| Comparative Example 14 | ◎ | ◎ | ◎ | ◎ | ◎ | ○ | Δ | X | X | X |

TABLE 9

(3) Lead-off (Unit: ×10,000)

| Environment<br>Number of copies | N/N<br>Initial state | N/N<br>1 | N/N<br>3 | N/N<br>5 | H/H<br>6 | N/N<br>8 | N/N<br>10 | H/H<br>15 | N/N<br>20 | N/N<br>25 | N/N<br>30 |
|---|---|---|---|---|---|---|---|---|---|---|---|
| Example 1 | ◎ | ◎ | ◎ | ◎ | ◎ | ◎ | ◎ | ◎ | ◎ | ◎ | ◎ |
| Example 2 | ◎ | ◎ | ◎ | ◎ | ◎ | ◎ | ◎ | ◎ | ◎ | ◎ | ◎ |
| Example 3 | ◎ | ◎ | ◎ | ◎ | ◎ | ◎ | ◎ | ◎ | ◎ | ◎ | ◎ |
| Example 4 | ◎ | ◎ | ◎ | ◎ | ◎ | ◎ | ◎ | ◎ | ◎ | ◎ | ◎ |
| Example 5 | ◎ | ◎ | ◎ | ◎ | ◎ | ◎ | ◎ | ◎ | ◎ | ◎ | ◎ |
| Example 6 | ◎ | ◎ | ◎ | ◎ | ◎ | ◎ | ◎ | ◎ | ◎ | ◎ | ◎ |
| Example 7 | ◎ | ◎ | ◎ | ◎ | ◎ | ◎ | ◎ | ◎ | ◎ | ◎ | ◎ |
| Example 8 | ◎ | ◎ | ◎ | ◎ | ◎ | ◎ | ◎ | ◎ | ◎ | ◎ | ◎ |
| Example 9 | ◎ | ◎ | ◎ | ◎ | ◎ | ◎ | ◎ | ◎ | ○ | ○ | ○ |
| Example 10 | ◎ | ◎ | ◎ | ◎ | ◎ | ◎ | ◎ | ◎ | ○ | ○ | ○ |
| Comparative Example 7 | ◎ | ○ | Δ | X | X | X | X | X | X | X | X |

TABLE 10

(3) Lead-off (Unit: ×10,000)

| Environment<br>Number of copies | N/N<br>Initial state | N/N<br>1 | N/N<br>3 | N/N<br>4 | H/H<br>5 | N/N<br>6 | N/N<br>7 | H/H<br>8 | N/N<br>9 | N/N<br>10 |
|---|---|---|---|---|---|---|---|---|---|---|
| Example 11 | ◎ | ◎ | ◎ | ◎ | ◎ | ◎ | ◎ | ◎ | ◎ | ◎ |
| Example 12 | ◎ | ◎ | ◎ | ◎ | ◎ | ◎ | ◎ | ◎ | ◎ | ◎ |
| Example 13 | ◎ | ◎ | ◎ | ◎ | ◎ | ◎ | ◎ | ◎ | ◎ | ◎ |
| Example 14 | ◎ | ◎ | ◎ | ◎ | ◎ | ◎ | ◎ | ◎ | ◎ | ◎ |
| Example 15 | ◎ | ◎ | ◎ | ◎ | ◎ | ◎ | ◎ | ◎ | ◎ | ◎ |

TABLE 10-continued (3) Lead-off (Unit: ×10,000)

| Environment<br>Number of copies | N/N<br>Initial state | N/N<br>1 | N/N<br>3 | N/N<br>4 | H/H<br>5 | N/N<br>6 | N/N<br>7 | H/H<br>8 | N/N<br>9 | N/N<br>10 |
|---|---|---|---|---|---|---|---|---|---|---|
| Example 16 | ◎ | ◎ | ◎ | ◎ | ◎ | ◎ | ◎ | ◎ | ◎ | ◎ |
| Example 17 | ◎ | ◎ | ◎ | ◎ | ◎ | ◎ | ◎ | ◎ | ◎ | ◎ |
| Example 18 | ◎ | ◎ | ◎ | ◎ | ◎ | ◎ | ◎ | ◎ | ◎ | ◎ |
| Example 19 | ◎ | ◎ | ◎ | ◎ | ◎ | ◎ | ◎ | ○ | ○ | ○ |
| Example 20 | ◎ | ◎ | ◎ | ◎ | ◎ | ◎ | ◎ | ○ | ○ | ○ |
| Comparative Example 14 | ◎ | ○ | Δ | X | X | X | X | X | X | X |

The application of the present invention makes it possible to prevent the occurrence of fog and lead-off for a long time, and also to reduce the carrier consumption.

What is claimed is:

1. A magnetic carrier comprising:

a BET specific surface area in a range of 0.50 to 2.00 $m^2/g$, and a dynamic current value in a range of 15 to 170 nA.

2. The magnetic carrier of claim 1, wherein said BET specific surface area is in a range of 0.51 to 1.85 $m^2/g$.

3. The magnetic carrier of claim 1, wherein said dynamic current value is in a range of 20 to 150 nA.

4. The magnetic carrier of claim 1, wherein said carrier has an average particle size in a range of 20 to 80 $\mu$m.

5. The magnetic carrier of claim 1, wherein said carrier has an average particle size in a range of 20 to 50 $\mu$m.

6. The magnetic carrier of claim 1, wherein said magnetic carrier comprises sinter obtained by sintering magnetic particles.

7. The magnetic carrier of claim 6, wherein said magnetic particles have an average primary particle size of 0.01 to 1 $\mu$M.

8. The magnetic carrier of claim 6, wherein each of said magnetic particles has a surface layer containing a metal other than iron.

9. The magnetic carrier of claim 8, wherein said metal other than iron is at least one kind of metal selected from the group consisting of aluminum, magnesium, zinc, manganese, silica, nickel, cobalt, copper, and cadmium.

10. The magnetic carrier of claim 6, wherein said magnetic particles are magnetite particles.

11. The magnetic carrier of claim 10, wherein each of said magnetite particles has a surface layer containing a metal other than iron.

12. The magnetic carrier of claim 11, wherein said metal other than iron is at least one kind of metal selected from the group consisting of aluminum, magnesium, zinc, manganese, silica, nickel, cobalt, copper, and cadmium.

13. The magnetic carrier of claim 11, wherein said metal other than iron is at least one kind of metal selected from the group consisting of aluminum, magnesium and zinc.

14. The magnetic carrier of claim 6, wherein said sinter are obtained by melt-kneading magnetic particles and a resin, pulverizing the resulting kneaded material, and sintering the resulting pulverized material.

15. A two-component developer comprising:

a magnetic carrier having a BET specific surface area in a rang of 0.50 to 2.00 $m^2/g$ and a dynamic current value in a range of 15 to 170 nA; and a negatively chargeable toner.

16. The developer of claim 15, wherein said magnetic carrier comprises sinter obtained by sintering magnetic particles.

17. The developer of claim 15, wherein said BET specific surface area is in a range of 0.51 to 1.85 $m^2/g$ and a dynamic current value in a range of 20 to 150 nA.

18. A manufacturing method of a magnetic carrier comprising:

melt-kneading magnetic particles having an average primary particle size in a range of 0.01 to 1 $\mu$m and a resin;

pulverizing the resulting kneaded material; and sintering the resulting pulverized particles;

wherein, the magnetic carrier has a BET specific surface area of 0.50 to 2.00 $m^2/g$ and a dynamic current value in a range of 15 to 170 nA.

19. The method of claim 18, further comprising:

classifying the sinter obtained in the sintering process.

20. The method of claim 19, wherein the sinter have an average particle size in a range of 20 to 80 $\mu$m, a BET specific surface area of 0.50 to 2.00 $m^2/g$ and a dynamic current value in a range of 15 to 170 nA.

* * * * *